United States Patent [19]

Howard et al.

[11] Patent Number: 4,617,547

[45] Date of Patent: Oct. 14, 1986

[54] HEATER ASSEMBLY

[75] Inventors: H. Keith Howard; Jimmy L. Sherrill, both of Cookeville; Robert L. Kirby, Sparta, all of Tenn.

[73] Assignee: Tutco, Inc., Cookeville, Tenn.

[21] Appl. No.: 602,434

[22] Filed: Apr. 20, 1984

[51] Int. Cl.[4] ..... H01C 1/01

[52] U.S. Cl. ..... 338/317; 338/315; 338/318; 338/290; 338/278; 219/374; 219/375; 219/532

[58] Field of Search ..... 219/374, 375, 377, 532, 219/370, 366, 532; 338/317, 315, 318, 290, 278, 291

[56] References Cited

U.S. PATENT DOCUMENTS

| | | | |
|---|---|---|---|
| 737,689 | 9/1903 | Wirt | 219/374 X |
| 1,636,369 | 7/1927 | Johnson | 219/351 |
| 1,679,841 | 8/1928 | Shaw | 219/532 |
| 2,235,764 | 3/1941 | Hynes | 219/366 X |
| 3,486,003 | 12/1969 | Cox | 219/374 X |
| 3,668,303 | 6/1972 | Alexander | 219/532 |
| 3,697,727 | 10/1972 | Neuman et al. | 219/374 X |
| 3,860,788 | 1/1975 | Staples | 219/375 X |
| 4,330,933 | 5/1982 | Glucksman et al. | 29/612 |
| 4,337,390 | 6/1982 | Best | 219/374 X |
| 4,393,082 | 8/1983 | Johannsen | 219/370 |

*Primary Examiner*—Clarence L. Albritton
*Assistant Examiner*—M. M. Lateef
*Attorney, Agent, or Firm*—Berman, Aisenberg & Platt

[57] ABSTRACT

A heater assembly includes a housing which both channels air flowing around a heating element and provides support structure for the elements holding the heating element. In one embodiment, a lower U-shaped channel has recesses in opposed sidewalls to engage downturned ends of holding elements. A second U-shaped channel is attached to form a hollow duct open at opposite ends. In a second embodiment, a U-shaped channel is made of flexible material so that the spacing between opposed sidewalls may be varied. A holding element is secured between the sidewalls by separating the sidewalls to allow insertion of the holding means.

17 Claims, 10 Drawing Figures

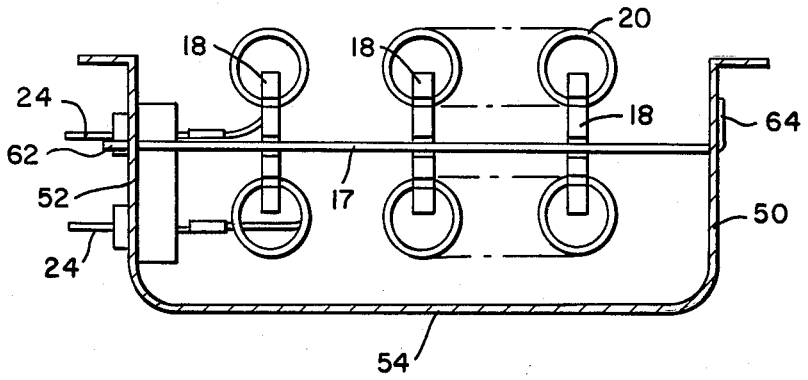
FIG. 9
FIG. 10
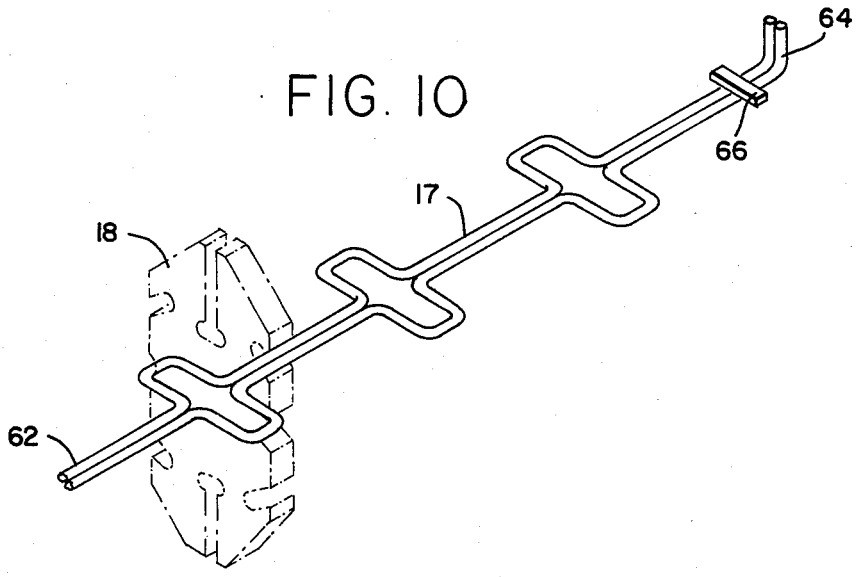

HEATER ASSEMBLY

FIELD OF THE INVENTION

This invention relates to the art of electric heaters, and in particular the art of electric heater assemblies using a coiled resistive heater element.

BACKGROUND ART

Electric heating assemblies are known in the art. An assembly comprising a resistive heating element, which is usually coiled, and provides insulating supports for engaging the heating element. In a typical construction, a coiled resistive element is engaged by a plurality of insulators, and the insulators are in turn secured to a frame. The frame is made of wire and provides a rigid structure for supporting the resistive element. The frame is then inserted into a duct for contact with a stream of air flowing within the duct.

U.S. Pat. No. 3,486,003 (Cox) shows a heater assembly having upper and lower housing portions. Ceramic support elements extend across an open channel formed by the two housing portions. A resistive heater wire is wound around each of the ceramic support elements to heat air flowing through the channel. The heater wire has no span where it supports itself and is entirely coiled around a ceramic support element.

U.S. Pat. Nos. 1,679,841 (Shaw), 1,636,369 (Johnson), and 3,860,788 (Staples) are representative of heater assemblies wherein a rigid frame supports portions of a coiled electric resistance wire. The frame is placed in a duct which directs air past the heater element.

Other heater elements using a frame are shown in U.S. Pat. Nos. 4,337,390 (Best), 3,697,727 (Neuman, et al.) and 2,235,764 (Hynes).

U.S. Pat. No. 4,330,933 (Glucksman, et al.) shows a resistive heater element wound around a star-shaped carrier. The carrier is in turn supported within a duct.

U.S. Pat. No. 3,668,303 (Alexander) shows an electric heater assembly having triangular insulating elements which engage helically coiled resistive heating wire. The insulating supports are engaged by a wire frame to provide rigidity.

U.S. Pat. No. 737,689 (Wirt) shows a plurality of cylindrical support tubes having heater coil wire wound around their exteriors. A frame supports a plurality of these tubes to provide a heater assembly.

SUMMARY OF THE INVENTION

Heater assemblies according to the prior art are expensive and unduly complicated because of their use of a rigid frame to support a coiled heater element separate from a duct or other enclosure. In accordance with the invention, a housing provides both a duct for directing the flow of air to be heated and a supporting structure for a coiled heater element. Holding elements extend across the housing and are spaced at a plurality of locations along the housing. Each of these holding means secures a plurality of insulators, and the insulators in turn engage and support the heater coil. The holding means is attached directly to opposed sidewalls of the housing, thus eliminating the prior art frame.

In a first embodiment, a U-shaped housing channel has opposed sidewalls with a plurality of recesses. The holding element has down-turned ends, each of which is received in a recess in the sidewall. An upper U-shaped housing channel is secured to the lower channel to form a hollow duct having open ends. This duct may then be placed directly in series with a forced air system. Thus, simplicity of manufacture and consequent lower cost are provided. The housing may be made of sheet metal or other appropriate material.

In a second embodiment, a U-shaped housing channel has flexible sidewalls. The sidewalls have apertures for receiving ends of the holding elements, and the sidewalls are flexible to allow them to be spread apart to receive the holding element. After the holding element has been inserted between the sidewalls, the resiliency of the sidewalls causes them to pull together to engage the holding element. The channel of the second embodiment may be covered with a second U-shaped channel housing, but it preferably has a flange for attached it to the bottom of an existing forced air system.

It is an object of this invention to provide an electric heater having a housing for channeling the flow of air and for supporting a coiled heater element.

It is further object of this invention to provide a housing for directing a flow of air wherein the housing has a plurality of recesses in sidewalls for receiving holding elements to support a heater element.

It is yet another object of this invention to provide a housing having opposed sidewalls wherein the spacing between the sidewalls may be varied to allow the insertion of a holding means and for supporting a heater element.

BRIEF DESCRIPTION OF THE DRAWINGS

FIG. 3 is a cross section taken along line 4—4 of FIG. 1.

FIG. 9 is a a cross-section taken along line 9—9 of FIG. 8.

FIG. 10 is a perspective of a holding means in accordance with the second embodiment of the invention.

DETAILED DESCRIPTION OF THE DRAWINGS

Figure 1:
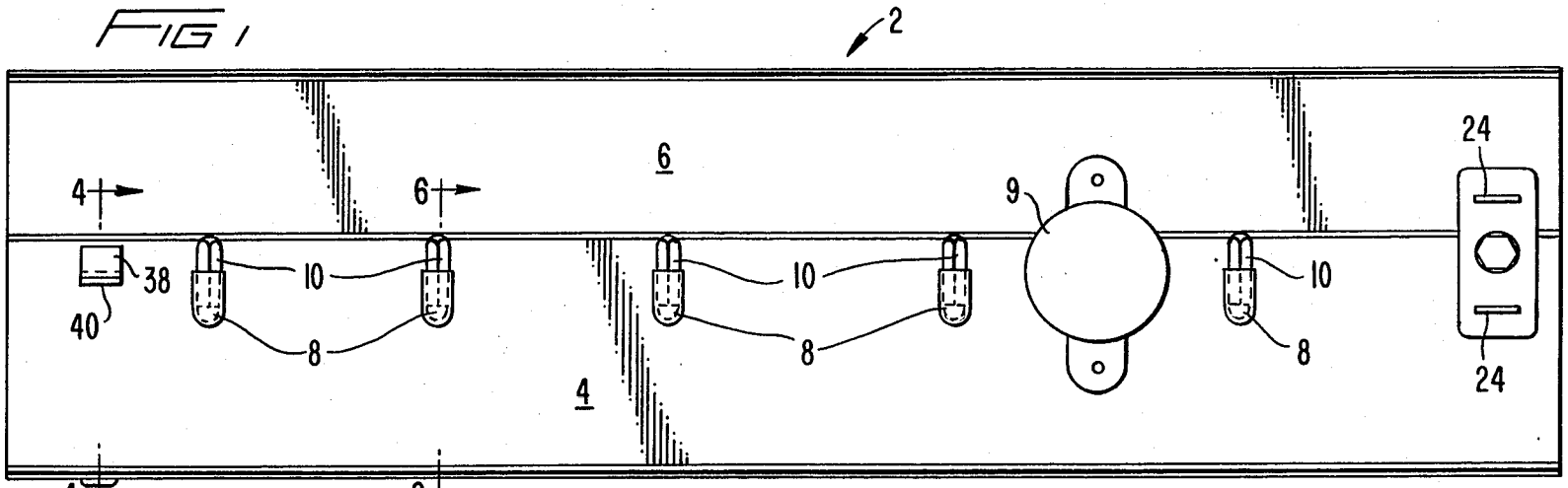
FIG. 1 is a side view of the first embodiment of the invention.

FIG. 1 shows a side view of an assembly 2 in accordance with the invention. Assembly 2 includes a housing formed by a lower portion 4, and an upper portion 6. The upper and lower portions 4, 6 are preferably U-shaped channels, as will be more fully described below. The lower portion 4 includes a plurality of recesses 8, each of which receives an end 10 of a holding element. A hole 9 allows a temperature probe to be attached to the housing to monitor the temperature of the flowing air. This feature may be eliminated if such is not necessary.

Figure 2:
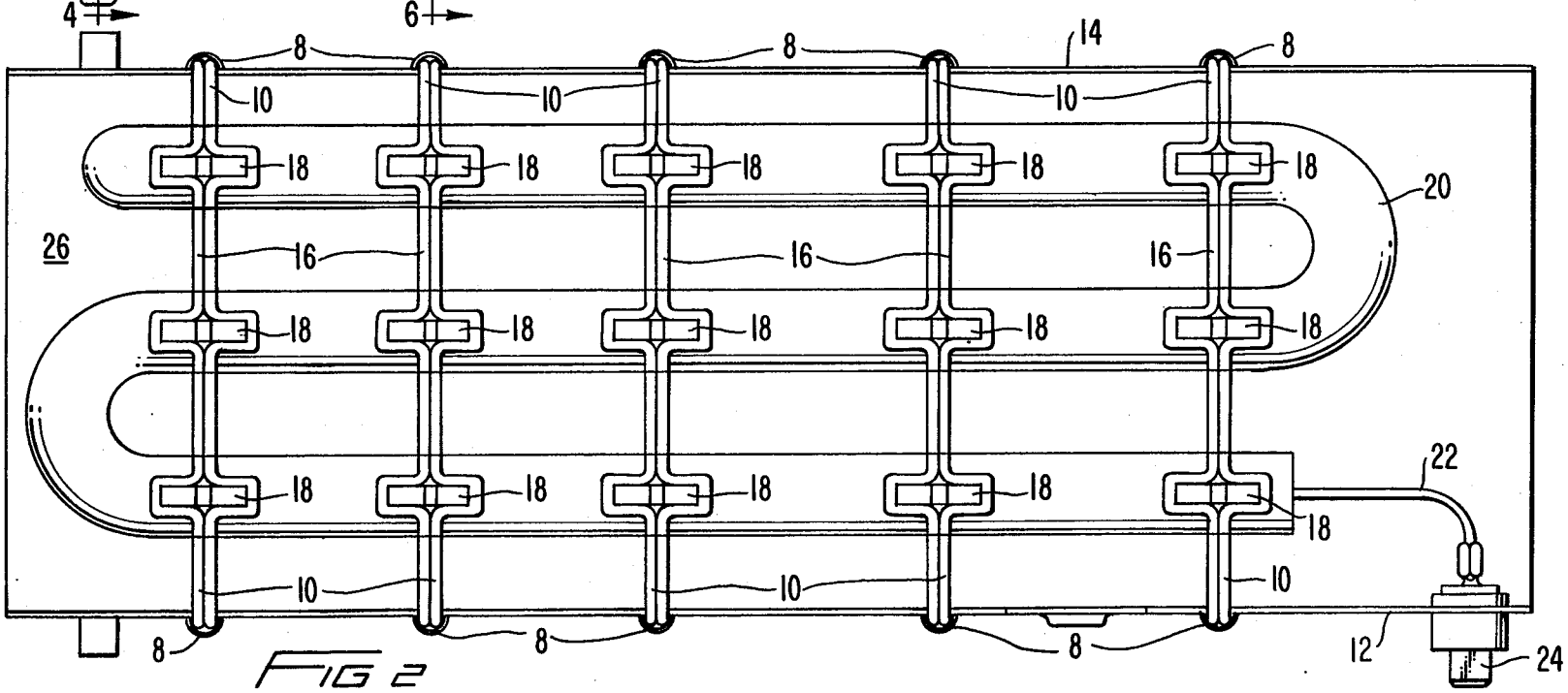
FIG. 2 is a top view of the lower part of the first embodiment of the invention.

FIG. 2 is a top view of the lower portion 4 of the housing. This portion is formed by opposed sidewalls 12 and 14, and each of these sidewalls has recesses 8 formed along an upper edge. Recesses 8 are spaced along respective sidewalls 12, 14 by equal distances and preferably face each other to receive holding elements 16 which extend directly across the lower portion 4. The holding elements 16 are held in the recesses 8 by engagement of down-turned ends 10 with recesses 8 as will be more fully described below.

Each of the holding elements 16 engages insulating elements 18. In the preferred embodiment, the holding elements 16 comprise two wires which form openings for receiving the insulators 18 and are secured together in portions adjacent the openings. The ends 10 are formed by bending the wires downwardly. The holding element 16 may be alternatively formed by a sheet metal plate or other equivalent structure.

A heating element 20, which is preferably a helically coiled resistive heating element is secured to the insulators 18 in a serpentine path. Leads 22 are connected to external terminals 24 for providing an electric current to the heating element 20.

The lower portion 4 also includes a bottom wall 26 which extends between sidewalls 12 and 14 to form a U-shaped channel.

Figure 3:
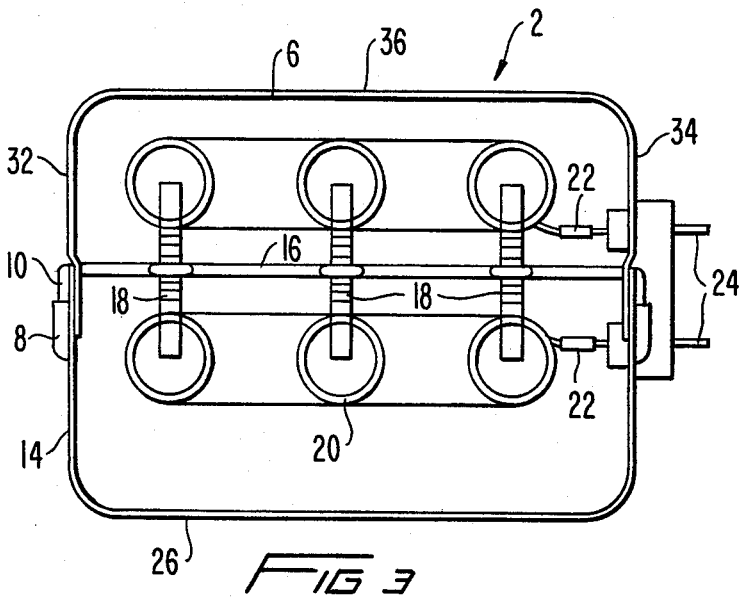
FIG. 3 is an end view of the first embodiment shown in FIG. 1.

FIG. 3 is an end view of the embodiment shown in FIG. 1 and shows how the upper portion 6 and the lower portion 4 are joined together to form a hollow housing, or duct, which is open at opposite ends. This joining of the upper and lower portions also secures holding elements 16 so that the upper and lower portions provide a rigid frame for supporting the heater element in addition to providing a hollow duct. The upper portion 6 preferably includes sidewalls 32 and 34 and an upper wall 36 connecting the sidewalls 32 and 34.

Figure 4:
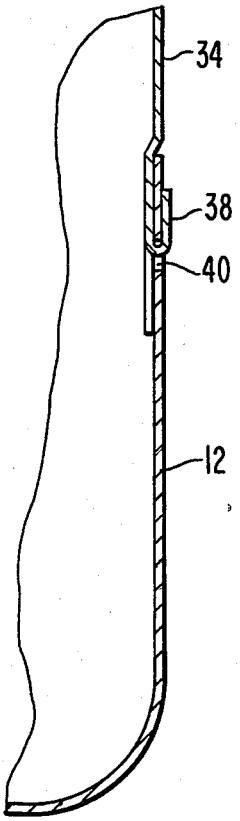

FIG. 4 shows the preferred structure for securing the upper and lower portions 4 and 6 together. Sidewall 34 includes a tab 38 which is cut from the material of the sidewall 34. Sidewall 12 of the lower portion 4 has an aperture 40 for receiving tab 38, and a secure connection is made when tab 38 is placed through the aperture 40 and bent upwardly as shown in FIG. 4. This simplifies construction by allowing the upper and lower portions to be quickly secured without screws, rivets, or the like.

Figure 5:
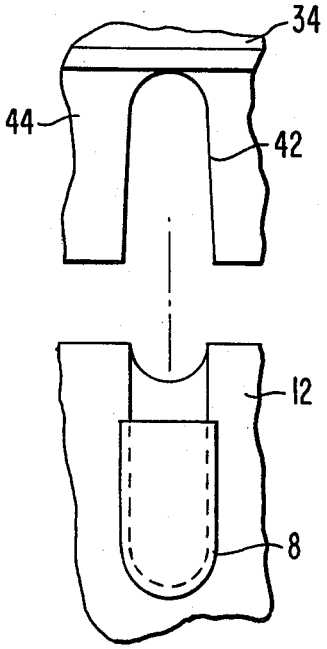
FIG. 5 is an exploded, partial view of the connection between the upper and lower portions of the first embodiment.
Figure 6:
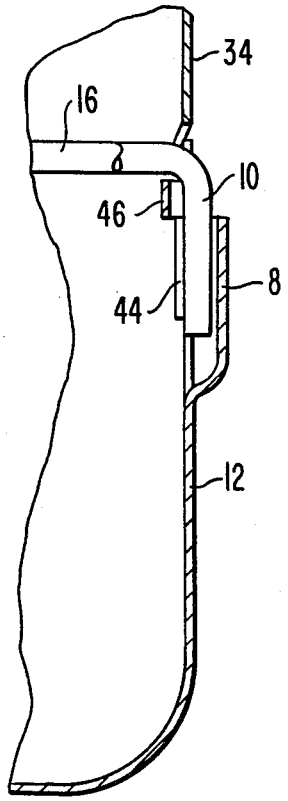
FIG. 6 is a cross section taken along line 6—6 of FIG. 1.

FIGS. 5 and 6 show in detail the manner in which ends 10 are engaged between the upper and lower portions 4, 6. Sidewall 34 of the upper portion 6 has a cutout 42 formed in an inwardly-displaced lip 44. Sidewall 12 has cylindrical recess 8 which extends outwardly for receiving an end 10 of the holding element 16. FIG. 6 shows a modification of the recess shown in FIGS. 1 through 5, and includes an additional inwardly directed recess 46. This inwardly directed recess is formed from the sidewall 12 and is semi-cylindrical. The inwardly directed recess 46 cooperates with the recess 8 to prevent movement of the end 10 in any direction.

It will be appreciated that the embodiment shown in FIGS. 1 through 6 provides a hollow duct having a heater element supported therein whereby the duct channels air through the heater elements and also provides structural support for the holding elements 16 to thereby support the heater coil. This assembly is a decided improvement over the prior art, particularly when considering that a helically coiled element may be employed. These elements are typically quite weak, especially when heated, and the duct in accordance with the invention provides adequate support without the necessity of a separate wire frame.

Figure 7:
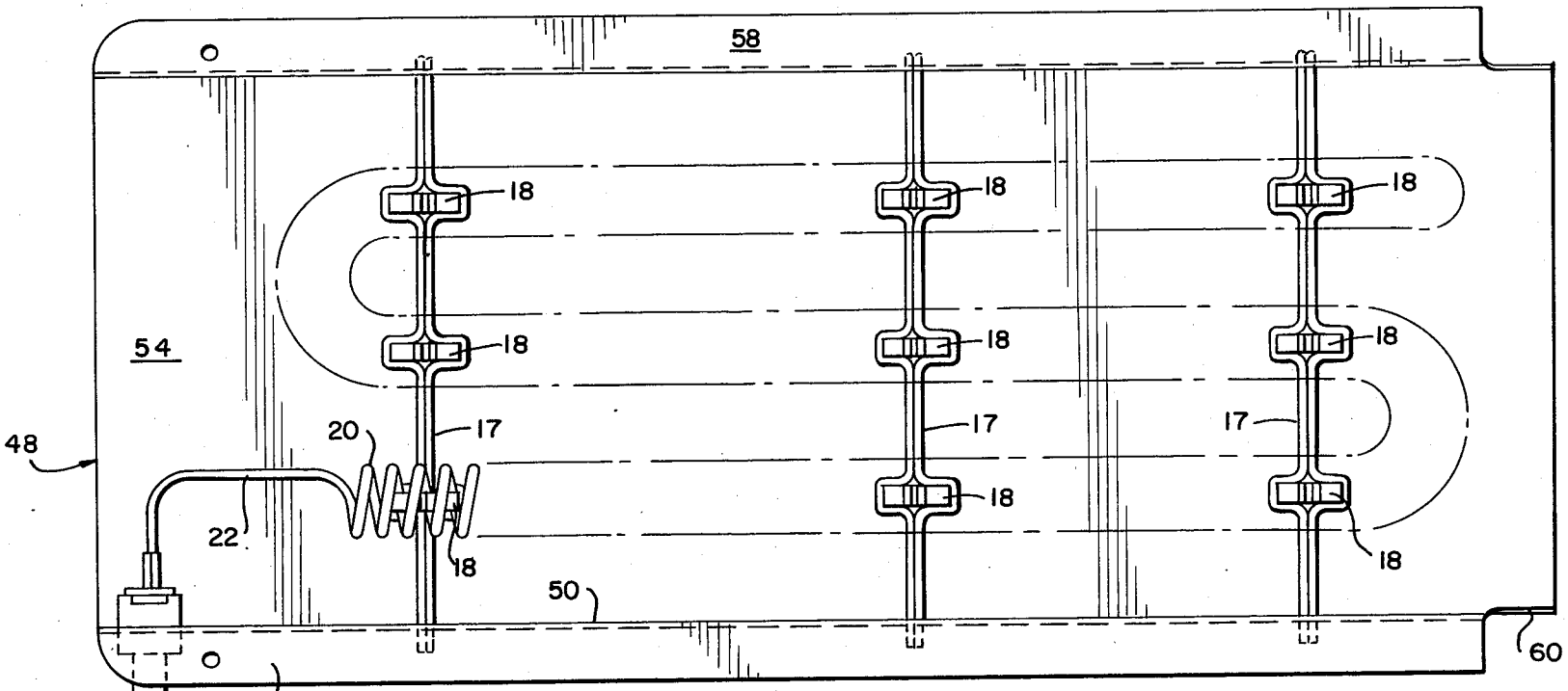
FIG. 7 is a top view of a second embodiment in accordance with the invention.

FIG. 7 illustrates another embodiment of the invention. Many of the elements are similar, and these similar elements are identified by the reference numerals employed in the description of FIGS. 1 through 6.

A duct 48 comprises sidewalls 50, 52 and a base wall 54. The sidewalls 50, 52 and the base wall 54 form a U-shaped channel housing which is open at its upper side. Flanges 56, 58 extend outwardly from respective sidewalls 50, 52 to allow the duct 48 to be secured to an existing duct, or similar structure.

Holding elements 17 extend between sidewalls 50, 52 and engage insulators 18. Holding elements 17 are similar to holding elements 16, but the ends are shaped differently, as will be shown in detail below. A heating element 20 is engaged by insulators 18 and is supported in a sinuous path between the sidewalls 50, 52. Leads 22 connect the heating element 20 to terminals 24.

Flanges 56, 58 extend only along a portion of respective sidewalls 50, 52 so that a connecting extension 60 is formed. This extension cooperates with a downstream duct (not shown) to produce an air-tight connection.

Figure 8:
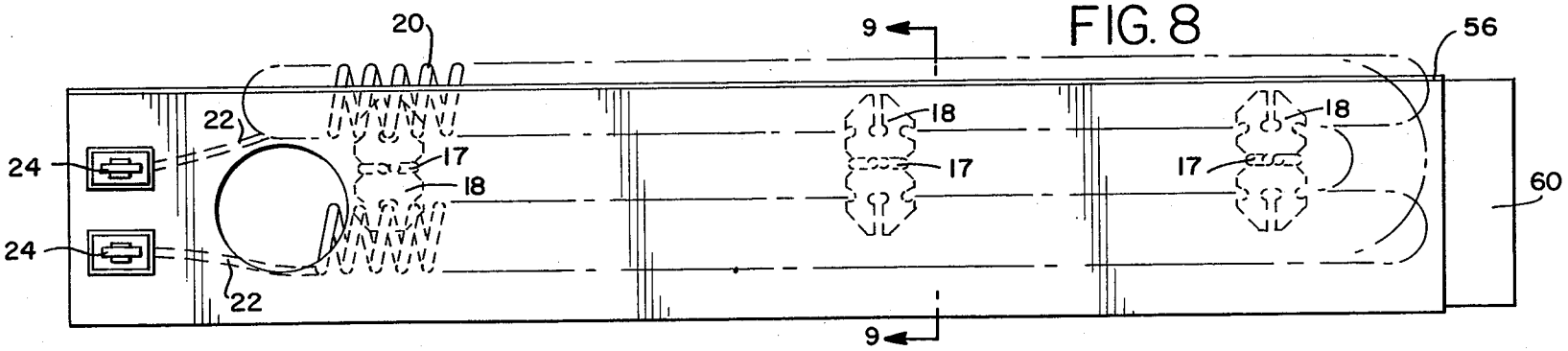
FIG. 8 is a side view of the embodiment shown in FIG. 7.

FIG. 9 is a cross-section taken along line 9—9 of FIG. 8 and shows a novel means of attaching the holding element 17 to the duct 48. Each of the sides 50, 52 includes an aperture therein to receive an end of the holding element 17. One end, 62 extends straight in the same direction as the holding element 17, while a second end 64 is bent upwardly from the direction of the holding element 17.

An important feature of the embodiment shown in FIGS. 7 through 10 is that the spacing between sidewalls 50, 52 may be varied. In the preferred embodiment, the spacing is varied by making the duct 48 of flexible sheet metal. Thus, end 64 may be inserted into an aperture in the sidewall 50 and the sidewalls may be then separated to allow insertion of end 62 into an opposed aperture in sidewall 52. Upon releasing the sidewalls, they will assume the position shown in FIG. 9 to secure the holding element 17 between the sidewalls. This is an extremely inexpensive and simple method of supporting holding element 17 between sidewalls 50, 52.

FIG. 10 is a perspective of holding element 17 used in the second embodiment and more clearly shows upturned end 64 and straight end 62. Insulator 18 is secured in openings formed between the wires as described above with respect to the first embodiment. A cross bar 66 is attached to holding element 17 a small distance from upturned end 64. Cross bar 66 engages the interior surface of side wall 50 to cooperate with end 64 to prevent any movement of holding element 17. Other techniques may alternatively be used, such as a small bend in one or both of the wires to form a protuberance.

It will be appreciated that the second embodiment shown in FIGS. 7 through 10 provides a unique and highly efficient duct which directs the flow of air around a heating element and provides a support frame for the heating element.

The parts may be put together in any of several ways. The preferred method is to place holding elements 16 or 17 with the insulators already in place in a jig. The heater element is then placed on the insulators, and the combination of holding elements, insulators and heater coil is then installed in the housing 48 or 4.

Modifications of the invention will be apparent to those of ordinary skill in the art.

What is claimed is:

1. A heater assembly comprising a housing for channeling air flow and having opposed sidewalls, a helically coiled heater element, insulator means for engaging said heater element at a plurality of spaced locations, a plurality of holding means for holding a plurality of said insulator means, each of said holding means having opposed ends, each of said ends is engaged with a respective one of said opposed sidewalls, wherein said sidewalls comprise means to receive said ends of said holding means, said plurality of holding means being spaced along said housing whereby said heater element, said insulators, and said holding means are supported only by said housing.

2. The assembly according to claim 1 wherein the spacing between said opposed sidewalls is variable to allow said spacing to be increased so that said holding means may be inserted between said sidewalls, and decreased to allow said sidewalls to engage said holding means.

3. The assembly according to claim 2 wherein one of said opposed ends of said holding means extends in a first direction and a second of said opposed ends has one portion which extends in said first direction and another portion which extends in a second direction transverse to said first direction.

4. The assembly of claim 3 wherein said means to receive comprises apertures formed in each of said sidewalls.

5. The assembly of claim 4 wherein said housing further comprises a base wall connecting said sidewalls.

6. The assembly of claim 1 wherein at least one of said side walls includes a cylindrical recess for engaging one of said opposed ends of said holding means.

7. The assembly of claim 6 wherein each of said opposed ends comprises a first portion extending in a first direction and a second portion extending in a second direction. amd wherein said recesses engage said second portions.

8. The assembly of claim 7 wherein said housing comprises a base wall connecting said sidewalls to form a first U-shaped channel, and a second U-shaped channel secured to said first U-shaped channel.

9. A heater assembly comprising an elongate heater element, adapted to produce heat by the flow of electrical current therethrough;

insulator means for engaging and supporting said elongate heater element, holding means for holding at least one of said insulator means, housing means for at least partially enclosing said heater element and for supporting said holding means and including opposed sidewalls, each of said sidewalls having means for receiving an end of said holding means the spacing between said sidewalls being variable to allow said spacing to be increased for insertion for said holding means between said sidewalls and decreased to engage said holding means, whereby said heater element, said insulator means, and said holding means are supported by said housing sidewalls.

10. A heater assembly according to claim 9 wherein said sidewalls are resilient.

11. A heater assembly according to claim 10 wherein said housing means further comprises a base wall connecting said sidewalls to form a U-shaped channel.

12. A heater assembly according to claim 11 wherein said means for receiving comprises opposed apertures one of said apertures being formed in each of said sidewalls and wherein said end of said holding means is received in one of said apertures.

13. A heater assembly according to claim 12 wherein a first end of said holding means extends in a first direction, and a second end of said holding means extends in a second direction transverse to said first direction, said first direction being aligned with said opposed apertures.

14. A heater assembly according to claim 13 wherein said holding means comprises two elongate elements which are secured together to form at least one opening to receive said insulator means and to form said first and second ends on opposite sides of said opening.

15. A heater assembly according to claim 14 wherein said elongate elements comprise cylindrical metal wire.

16. A heater assembly according to claim 15 wherein said housing means is of sheet metal.

17. A heater assembly according to claim 16 wherein said heater element is a helically coiled wire.

* * * * *